United States Patent [19]

Remington et al.

[11] 4,344,368

[45] Aug. 17, 1982

[54] UNIVERSAL PALLET

[75] Inventors: John L. Remington, Coplay; Robert W. Moyer, Allentown, both of Pa.

[73] Assignee: The Stanley Works, New Britain, Conn.

[21] Appl. No.: 165,278

[22] Filed: Jul. 2, 1980

[51] Int. Cl.[3] ..... B65D 19/28; B65D 19/44

[52] U.S. Cl. ..... 108/51.1; 108/55.1; 108/55.3; 108/56.1; 211/187; 211/208

[58] Field of Search ..... 108/51.1, 53.1, 53.5, 108/54.1–57.1; 206/386, 596, 598–600; 211/187, 208

[56] References Cited

U.S. PATENT DOCUMENTS

| | | | |
|---|---|---|---|
| 2,735,569 | 2/1956 | Averill | 206/600 X |
| 2,916,152 | 12/1959 | Dull | 108/55.3 X |
| 2,947,565 | 8/1960 | Wood | 108/55.3 X |
| 3,272,345 | 9/1966 | Wallace | 211/187 X |
| 3,348,723 | 10/1967 | Wilson | 108/53.5 X |
| 3,753,407 | 8/1973 | Tilseth | 108/55.5 X |
| 3,799,382 | 3/1974 | Munroe | 108/56.1 X |
| 4,062,300 | 12/1977 | Real | 108/56.1 X |
| 4,128,253 | 12/1978 | Powers | 108/55.1 X |
| 4,216,933 | 8/1980 | Cramer, Jr. | |

FOREIGN PATENT DOCUMENTS

| | | | |
|---|---|---|---|
| 1341934 | 9/1963 | France | 211/187 |
| 2291101 | 6/1976 | France | 108/55.1 |
| 205955 | 7/1966 | Sweden | 108/51.1 |
| 911150 | 11/1962 | United Kingdom | 211/189 |

*Primary Examiner*—William E. Lyddane
*Attorney, Agent, or Firm*—Woodcock, Washburn, Kurtz, Mackiewicz & Norris

[57] ABSTRACT

An improved pallet for the storage of goods is disclosed which features a generally planar basic pallet adapted for ready transport and storage and for affixation thereto of a plurality of superstructures, each superstructure being designed for storage of a specific class of goods. The basic pallet is suited for storage within a modular array of storage locations, and is adapted to mate with, e.g., a forklift truck for being moved, thus performing the dual functions of pallet adaptable for carriage of a variety of goods, and adjustable shelf.

9 Claims, 14 Drawing Figures

UNIVERSAL PALLET

FIELD OF THE INVENTION

This invention relates generally to the field of storing goods of various types. More specifically, the invention relates to pallets which are adapted to be stacked in modular storage systems, and which are made so as to be adaptable for storage of a wide variety of different types of goods.

BACKGROUND OF THE INVENTION

It has been common practice for many years in the field of goods storage and transport to store goods on pallets, typically comprising wooden platforms of uniform shape and size and having uniform apertures in their bases to enable ready transport of the goods by powered apparatus such as fork lift trucks and the like. Numerous different sorts of pallets adapted to more readily carry different sorts of goods have been shown in the prior art. See, e.g., U.S. Pat. No. 3,753,407 to Tilseth which shows a pallet which can be adapted to carry either flat or annularly shaped products. Another patent in this class is U.S. Pat. No. 3,431,870 to Naylor et al; see also U.S. Pat. No. 3,628,805 to Archer.

Another need addressed by the pallet art has been that requiring storage of empty pallets in limited spaces. To this end knock down pallets and modular pallet assemblies have been developed. See, for example, U.S. Pat. No. 3,327,654 to Duncan et al.; U.S. Pat. No. 3,176,632 to Yingling and U.S. Pat. No. 3,133,511 to Phillips.

Another feature sought to be made available by the prior art is the ready stacking of a plurality of pallets, either with or without goods placed thereon, for efficient use of floor space. See, e.g., U.S. Pat. No. 3,207,095 to Hiatt, Jr. as well as the patent to Duncan et al. referred to above. Examples of allied concepts found in related art fields are shown by the U.S. Patents to Giardini U.S. Pat. No. 3,857,494; Telfer U.S. Pat No. 3,480,154 and Downing U.S. Pat. No. 4,056,295.

Another feature of prior art pallets is adaptation to carriage by differing types of lift trucks; see U.S. Pat. No. 3,677,200 to Coccagna et al. The prior art also shows methods of adapting pallets to carry a larger quantity of goods; see U.S. Pat. No. 3,702,678 to Stephens et al.

It will apparent that it would be desirable to provide a pallet system which would comprise a first member which would be common to a wide variety of uses and corresponding additional members which could be readily added to the base member to adapt it for use for a wide variety of different types of goods. In addition to the patent to Tilseth referred to above, this has been addressed by U.S. Pat. No. 4,062,300 to Real. The Real patent suggests the use of a molded plastic basic pallet with various sorts of superstructures attachable thereto by use of elaborate spring loaded frangible pins.

Thus, while attempts have been made in the prior art to develop a pallet which is adaptable to a wide variety of uses, which is economical of space when not being used, and which is inexpensive of construction, it will be apparent that there remains room for improvement in the art of efficient storage of goods.

Beyond the pallet art discussed above, the related art includes vertical racks adapted for mating with pallets of specified design so that pallets laden with goods can be placed one above another in racks at spacings determined only by the vertical height of the goods on the pallets, thus conserving floor space. Thus, the shelf becomes the pallet, and vice versa. Prior art apparatus of this kind includes pallets having hooks and pegs adapted to interact with support means such that a pallet laden with goods can readily be placed between selected ones of vertical supports by an operator operating a fork lift, elevator, or the like and lowered onto spaced hooks so as to support the laden pallet in a vertical array. However, the pallets of such systems in the prior art have not been adapted to a variety of uses.

OBJECTS OF THE INVENTION

It is accordingly an object of the invention to provide an improved pallet system.

A further object of the invention is to provide a pallet system in which pallets are adaptable to a wide variety of types of goods to be stored.

A further object of the invention is to provide a pallet system comprising a basic pallet and a number of accessory superstructures which can be affixed to the basic pallet in order to adapt it for use with a wide variety of goods.

A further object of the invention is to provide a pallet storage system for use with pallets in turn adaptable for the efficient containment of a wide variety of classes of goods to be stored.

The final object of the invention is to provide a pallet system comprising a vertical storage array adapted to contain pallets, the pallets in turn being individually adaptable to be useful in the storage of different classes of goods, the whole being manufactured in a ready and inexpensive fashion.

SUMMARY OF THE INVENTION

The above needs of the art and objects of the invention are satisfied by the present invention which comprises a universal pallet, consisting of a base pallet which is generally planar and is adapted so as to be versatile with respect to the way in which it is transported, comprising apertures for mating with the tines of a fork lift, and used within a system consisting of numerous differing superstructures adapted to be affixed to the base pallet for containment of various sorts of goods. For example, a V-block structure may be provided to contain reels of material; wire mesh fences can be arranged to be a bin for containing large parts, or solid walls can be attached to contain small parts. One of the walls may be hinged to allow dumping of small parts. Molded tubs may be provided to contain liquids, powders or very tiny parts, and the bins or tubs themselves can be subdivided if a plurality of differing parts are desired to be stored in the same pallet without commingling. Furthermore, the base pallet may be adapted to be stored within vertical storage rack systems so as to optimize use of floor space, thus providing increased storage efficiency to such a system.

BRIEF DESCRIPTION OF THE DRAWINGS

The invention will be better understood if reference is made to the accompanying drawings, in which.

DESCRIPTION OF THE PREFERRED EMBODIMENTS

Figure 1:
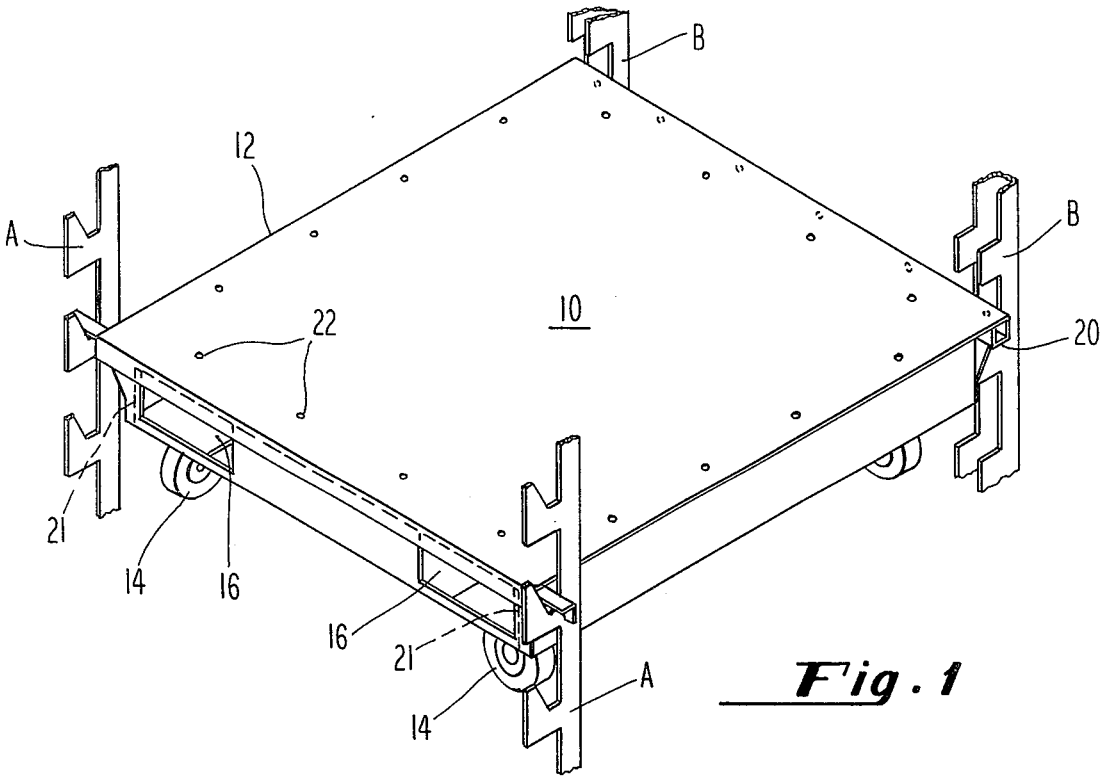
FIG. 1 represents a perspective view of the basic pallet according to the invention, fitted with casters, and shows how the pallets may be stored in a vertical array.
Figure 2:
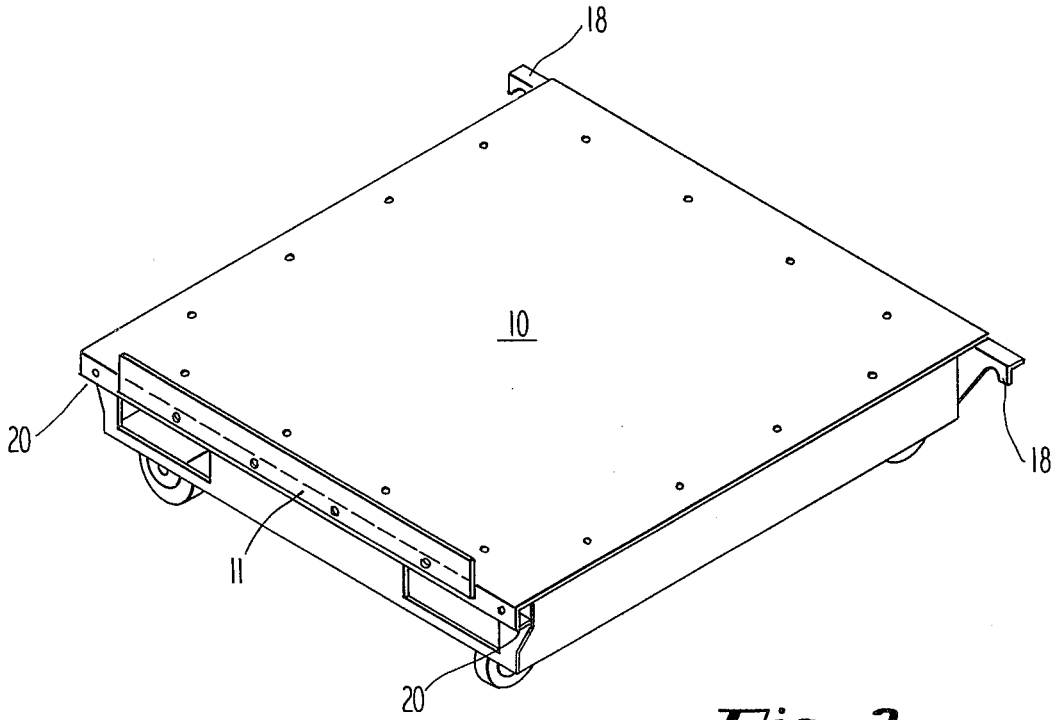
FIG. 2 represents a view of the pallet of FIG. 1, viewed from the reverse side as compared with FIG. 1.

FIGS. 1 and 2 both show overall perspective views from the front and back, respectively, of the pallet of the invention 10. FIG. 2 shows the basic pallet 12 having had an optional rear lip 11 fitted. The pallet 10 comprises a generally planar upper surface, indicated at 12, and may be fitted with casters 14 as shown to allow it to be rolled about the floor and has apertures 16 formed in its base underneath its top surface 12 for the insertion of the tines of a fork lift. The fork lift may be the common type in which forks attached to a powered vehicle are hydraulically moved up and down, or may be of the type in which the forks are attached to a goods elevator adapted to move back and forth with respect to a plurality of shelves. The pallet may also have a larger aperture, in any of the walls of its base as indicated in dotted lines 21, for mating with a floor truck. The pallet of the invention 10 may be provided with hooks 18 at the front and comprise a generally rectangular support bar 20 at its rear, to allow the pallet 10 to be readily stored in a coacting vertical support array, indicated generally by vertical front supports A, which confine the pallet to a horizontal as well as a vertical position, and rear supports B, which provide support to the rear of the pallet. Such a vertical pallet storage system is shown in the prior art, e.g., as described in various brochures published by the assignee of the present invention. According to this system the pallets of the invention may be stored at any convenient location and are not confined to predetermined shelves.

As discussed above, it is an object of the invention that the pallet 10 be provided with means for attachment of various superstructures which adapt the basic pallet 10 to a variety of uses. In a particularly preferred embodiment it is only required that a plurality of holes 22 be formed in the upper surface 12 of the pallet 10. These holes may be so sized as to enable connection of sheet metal screws, reusable plastic fasteners, ordinary machine screws or the like and may be spaced to allow attachment of varying superstructures for the storage of goods of various types, as discussed in further detail below.

Figure 3:
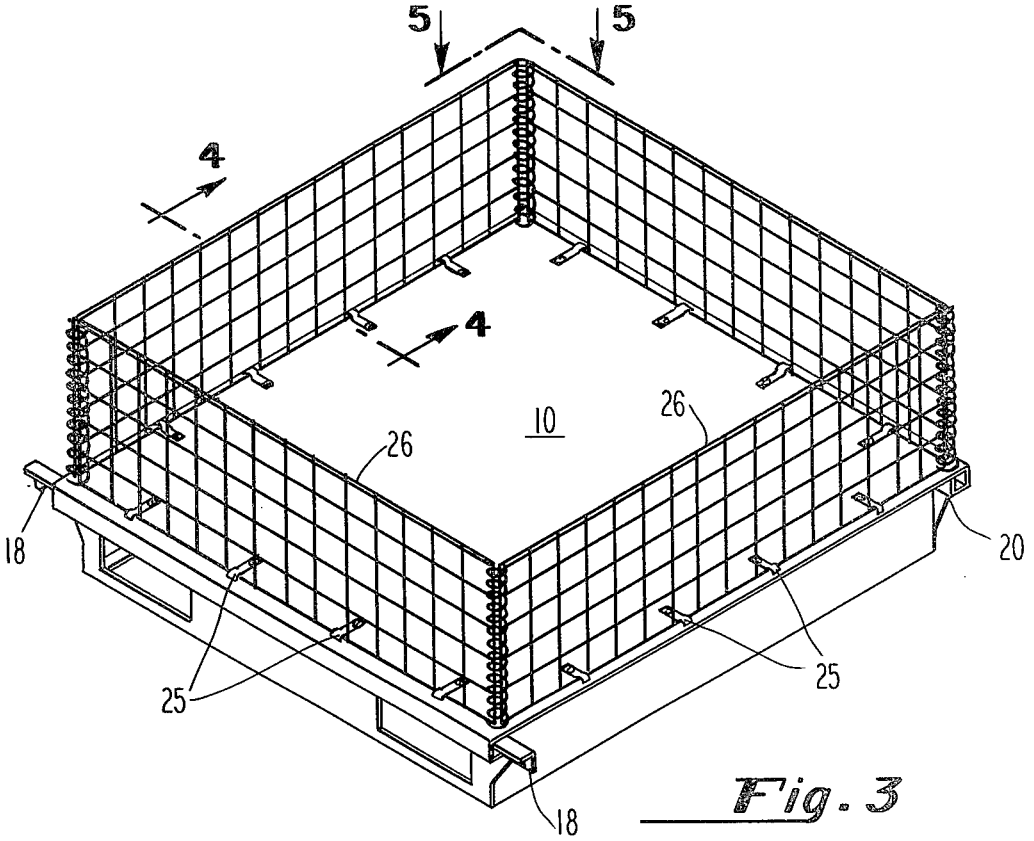
FIG. 3 shows the pallet of FIG. 1, having been fitted with a wire mesh enclosure for the containment of large parts.
Figure 5:
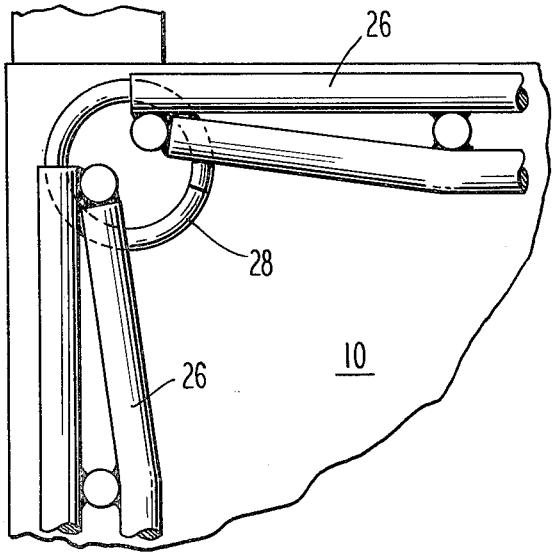
FIG. 5 represents a view looking downwards at the wire mesh-fitted pallet of FIG. 3, taken along line 5—5 of FIG. 3.
Figure 4:
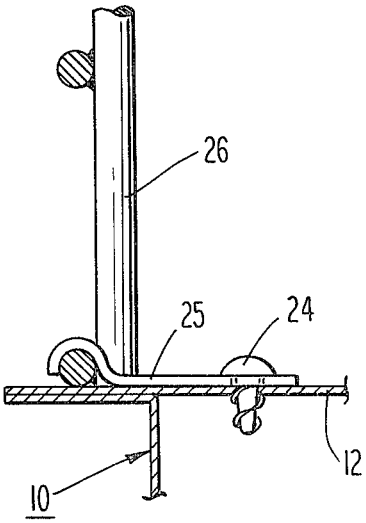
FIG. 4 represents a cross-sectional view taken along line 4—4 of FIG. 3.

One such superstructure, a wire mesh basket useful in storing large parts, is shown in connection with FIGS. 3, 4, and 5. As shown in FIGS. 3 and 5, the wire mesh basket can comprise four substantially equal lengths 26 of coarse wire mesh joined at their corners by wire spirals 28 which may be simply turned into engagement with the ends of the four panels 26 making up the mesh bin. As shown in FIG. 4, clips 25 may be used to hold the mesh bin assembly onto the pallet 10 by means of sheet metal screws indicated at 24.

As will be understood by those skilled in the art, in some circumstances it may be desirable to treat parts while contained in a bin. The pallet 10 of the invention, adapted by assembly of the mesh walls 26 or other superstructures detailed below, is readily suitable for this purpose. The material of the pallet and bin only need be chosen to withstand whatever treatment is desired to be performed on the parts, e.g., heat treating, acid dipping, or the like. Typically the pallet 10 may be made of a mild steel of, e.g., 16 or 18 gauge thickness and may be stamped, formed and spot welded into its desired configuration. The superstructures can be manufactured by similarly economical processes.

Figure 6:
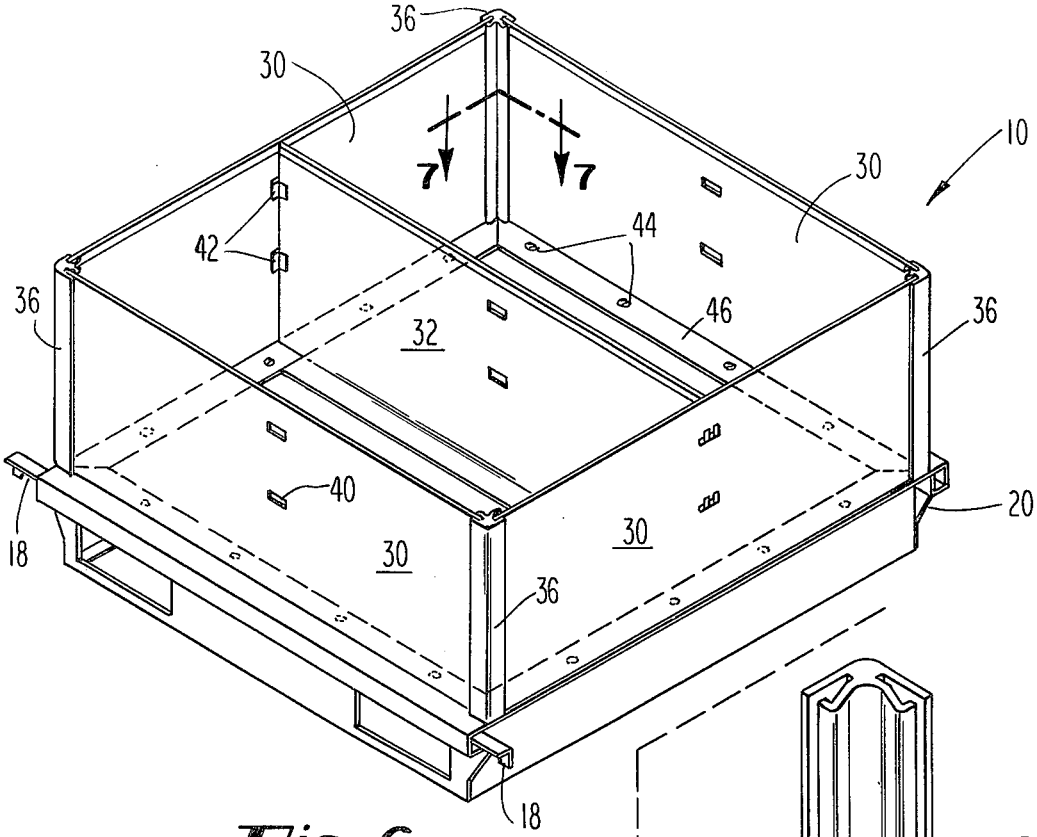
FIG. 6 shows the basic pallet of FIGS. 1 and 2 having been fitted with generally solid planar walls to form a bin.
Figure 8:
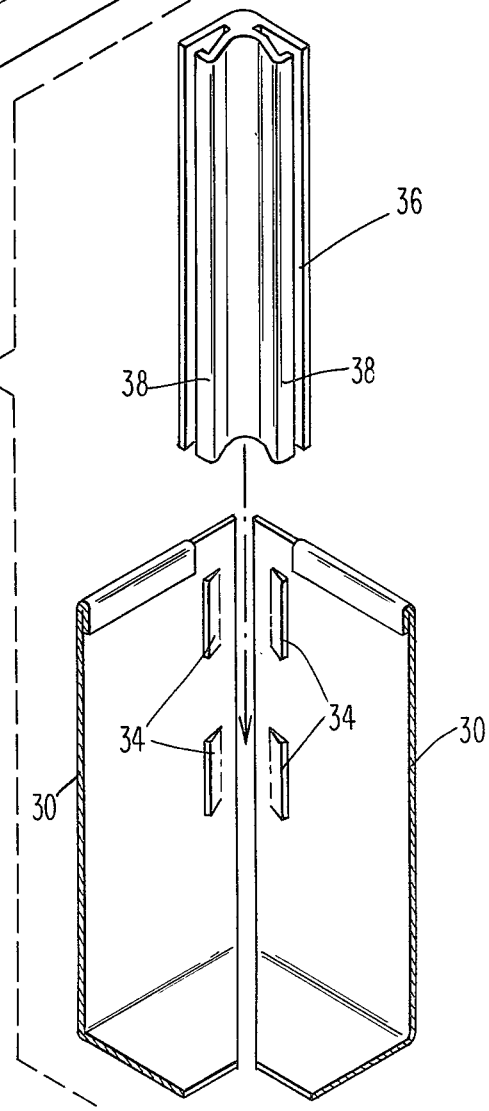
FIG. 8 shows an exploded view of such a corner, showing details of the assembly.
Figure 7:
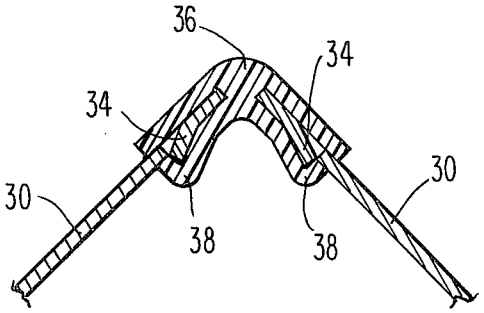
FIG. 7 shows a cross-sectional view taken along line 7—7 of FIG. 6, showing how the corners of the bin of FIG. 6 are constructed.

Referring now to FIGS. 6, 7, and 8, details of a second possible superstructure, a sheet metal box, are shown. There the pallet 10 is shown fitted with four substantially identical walls 30 and a central partition 32. The walls are assembled as shown in FIGS. 7 and 8. Lances 34 are formed in the walls 30 near their ends by punching a portion of the walls 30 partially inward. An extruded corner portion 36, preferably made of an easily extruded material such as plastic or aluminum, may then be slipped over the two ends of the walls 30 simultaneously as shown in FIG. 8. The extrusion 36 may be designed to comprise an L-shaped extension 38 sized to interact with the lances 34 to hold the corners of the bin together, as shown in FIG. 7. Each of the walls 30 may be provided with apertures 40 for the connection of clips 42 to hold the central partition 32 in place. The precise construction of the clips 42 and the means whereby the wall 32, as well as other partitions, may be assembled will be discussed in further detail below in connection with FIGS. 12 and 13. As was the case with the wire mesh bin of FIGS. 3, 4 and 5, the walls 30 may be held down to the basic pallet 10 by means of sheet metal screws 44 bearing on a flange 46 forming the base of each of the walls 30.

Figure 9:
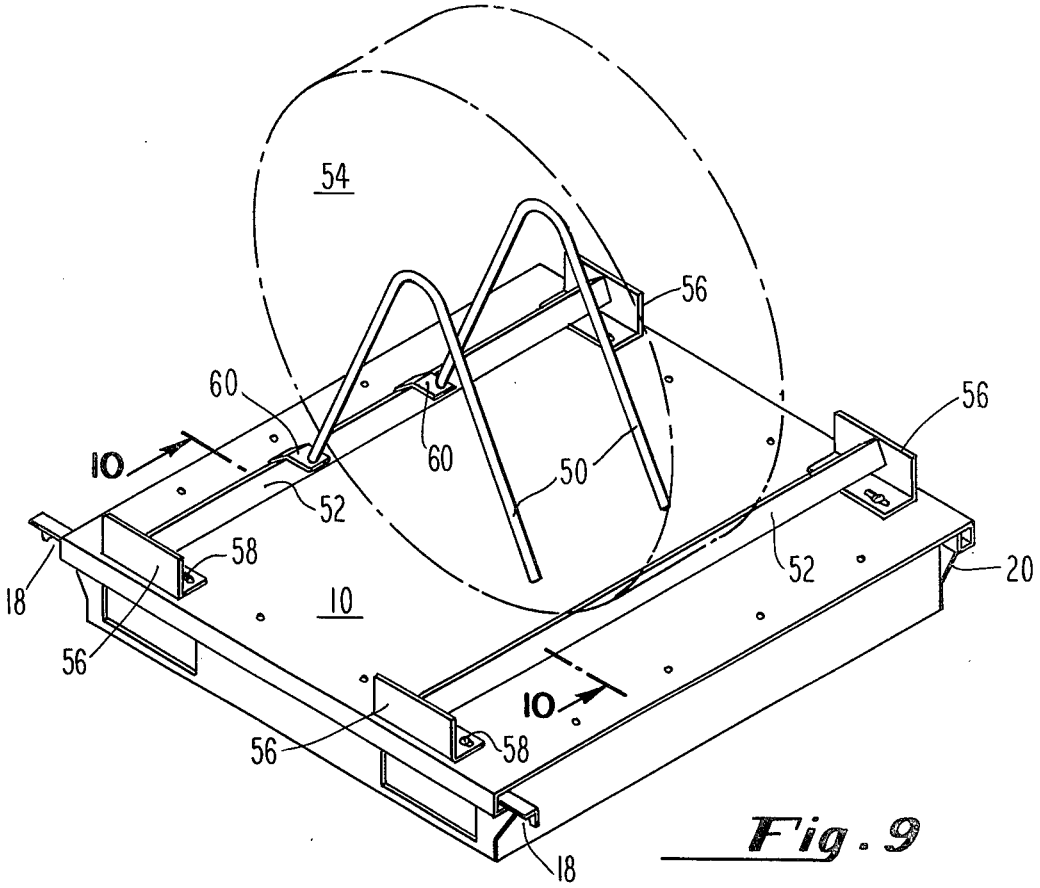
FIG. 9 shows the basic pallet of FIGS. 1 and 2 having been fitted with wire loops for the containment of reels of material.
Figure 10:
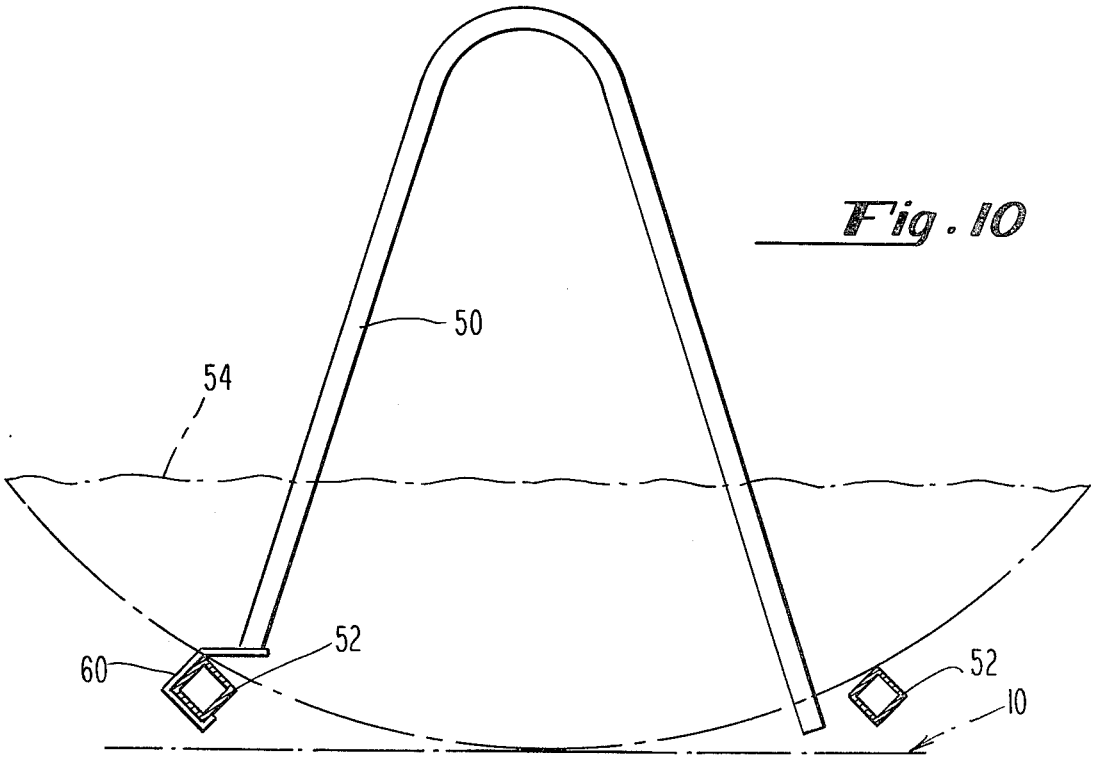
FIG. 10 shows a cross-sectional view taken along the line 10—10 of FIG. 9.

Referring now to FIGS. 9 and 10, a third superstructural possiblity two or more wire loops used to hold reels of goods such as electrical wire, is shown. There the pallet 10 is fitted with spaced apart wire loops 50 which are adjustably spaced along a bar 52 so as to accommodate reels (indicated in phantom generally at 54) of various widths. As shown in FIG. 10, the loops 50 may be attached to bars 52 by means of simple spring clips which enable the repositioning of the loops 50 to accommodate reels of various widths without tools. The bars 52 may be welded at their ends to angle brackets 56 which may then be screwed down to the pallet 10 by means of sheet metal screws 58 as described above in connection with other embodiments of the invention.

FIG. 10, a cross-sectional view taken along the line 10—10 of FIG. 9, shows how the loops 50 may be fitted with metal clips 60 which may be so sized as to provide a spring or resilient action providing clamping of the bar 52 by the bracket 60 so as to hold the loops 50 in place, while allowing repositioning thereof without tools.

Figure 11:
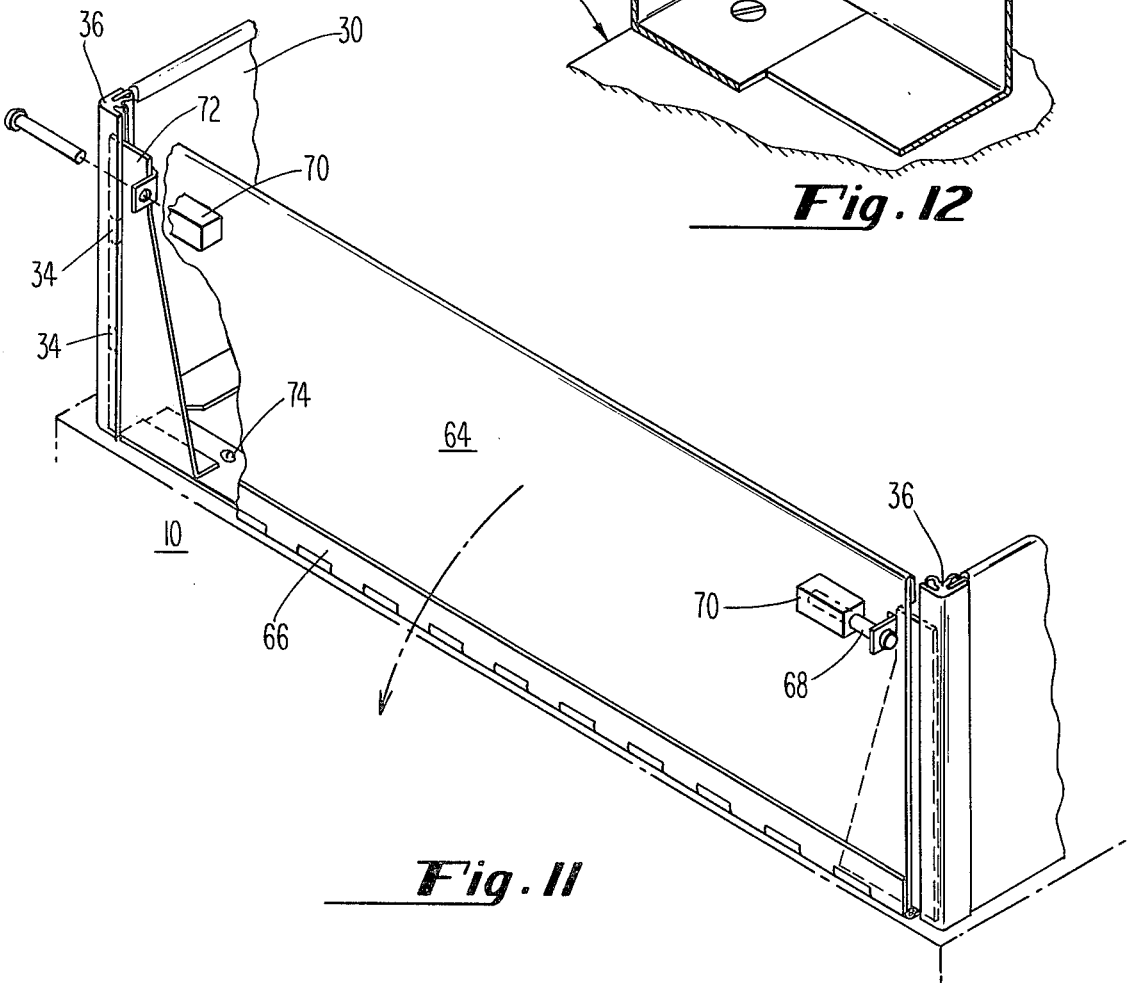
FIG. 11 shows a way in which one wall of the bin of FIGS. 6, 7 and 8 can be replaced by a hinged side panel to enable dumping of goods stored therein.

FIG. 11 shows a possible variation on the bin superstructure discussed above in connection with FIGS. 6 through 8. As shown in FIG. 11, one of the box walls 30 may be replaced with a door 64, hinged by a piano hinge 66 and held closed by a pair of pins 68 interacting with blocks 70 affixed to the door 64. In this way goods can be advantageously dumped from the container into a desired receptacle. The wall 30 comprising the door 64 comprises a pair of end brackets 72 which have lances 34 formed therein, as was shown above in connection with FIGS. 7 and 8, which interact with extruded corner brackets 36. The brackets 72 can be welded to the piano hinge 66 and the entire assembly held down to the pallet 10 by means of sheet metal screws 74.

Figure 13:
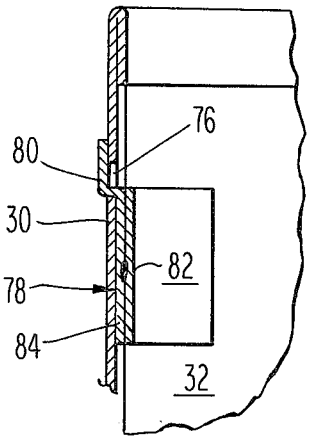
FIG. 13 is a line taken along line 13—13 of FIG. 12 showing clips used to hold such partitions in place.
Figure 12:
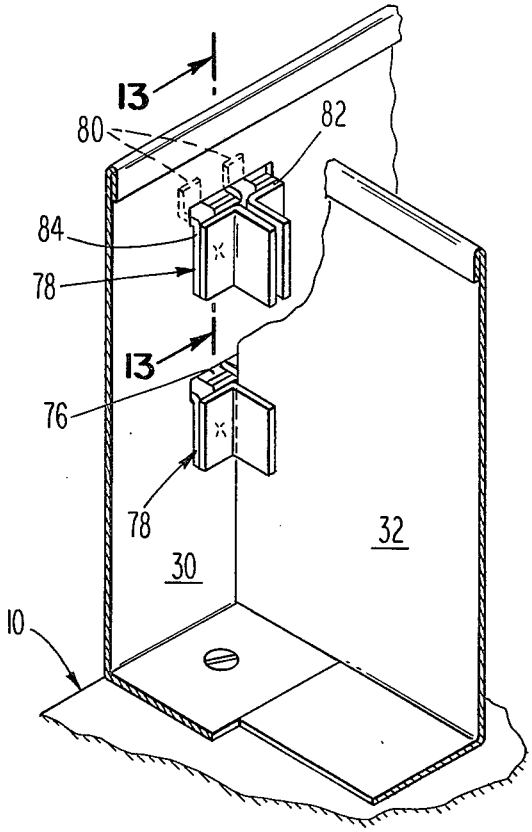
FIG. 12 shows a detail of how the partitions shown in the bin of FIG. 6 can be held in place.

Referring now to FIGS. 12 and 13, details of how partitions 32 may be affixed to the walls 30 are shown in the bin of FIGS. 6, 7 and 8. Referring to FIG. 12, the wall 30 is shown having two substantially rectangular apertures 76 formed therein which are sized so as to accept identical brackets 78. These brackets 78 each comprise a pair of ears 80 adapted to fit through the aperture 76 and support the bracket 78. The bracket 78 also comprises a pair of angle pieces 82 which may be formed of metal and spot welded (indicated by "x" in FIG. 12) to the back portion 84 in which the ears 80 are formed. The angle pieces 82 are spaced apart a distance sufficient to allow assembly of the partition 32 therebetween. A cross sectional view taken along the line 13—13 of FIG. 12 is shown as FIG. 13 and shows the relative size of the ears 80 fitting within the aperture 76, and the manner in which the spot weld, indicated as a spot, joins the angle brackets 82 to the back portion 84 of the bracket 78. Alternatively, the bracket 78 could be molded of plastic. It will be understood that one need only tilt the bracket 78 until the ears 80 may be inserted through the aperture 76 and then rotate the bracket downwardly until its back portion 84 abuts against the wall 30. The partition 32 can then simply be lowered between the spaced apart L portions 82; its weight is sufficient to hold it in place. It will be likewise appreciated that the partition 32 can also be provided with similar apertures 76 to allow the placement of supplemental partitions if desired.

Figure 14:
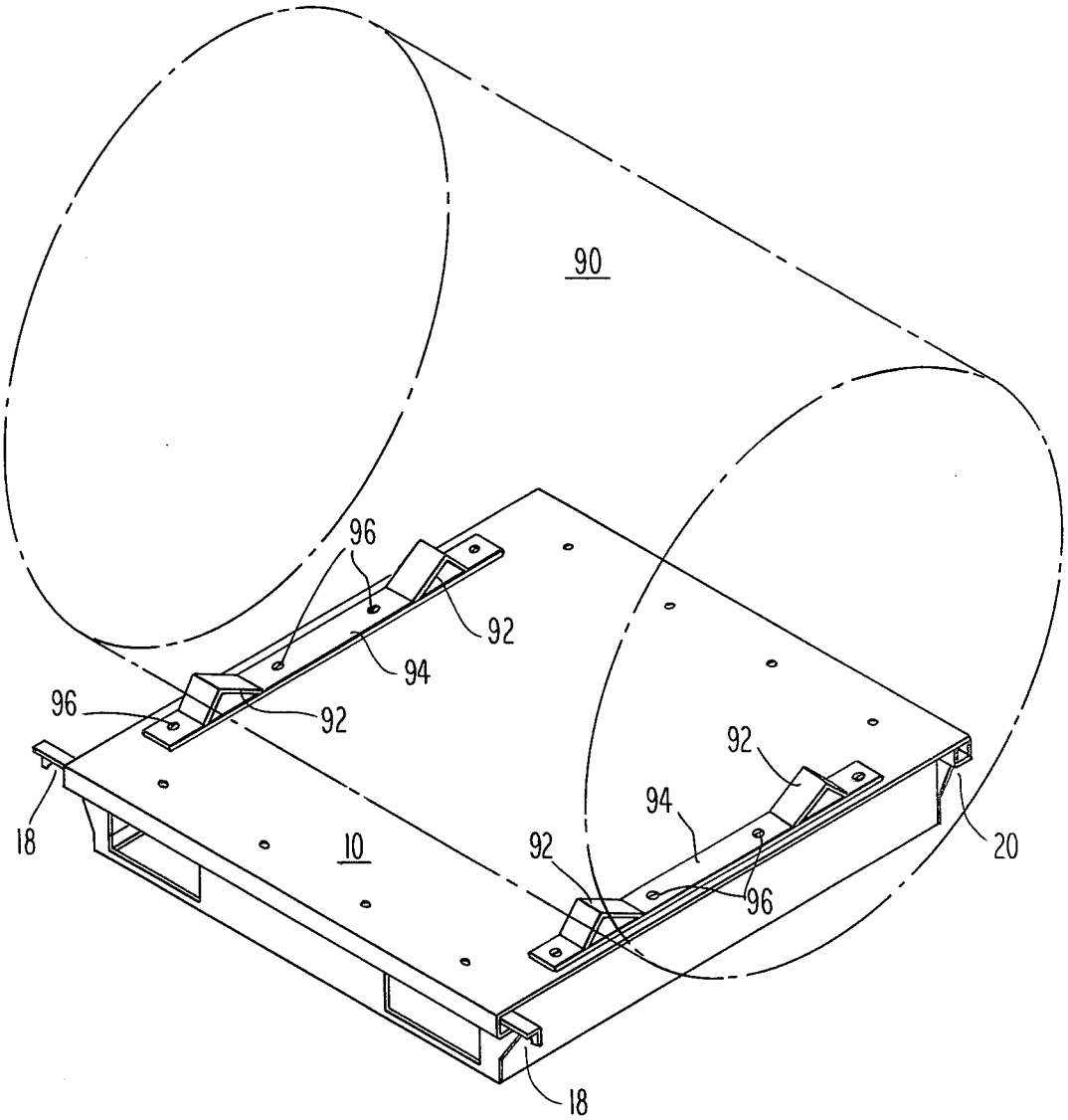
FIG. 14 is a view showing a way in which the pallet of FIGS. 1 and 2 can be adapted for the containment of large drums of material.

Referring now to FIG. 14 a final superstructure adaptable for attachment to the basic pallet 10 is shown. This superstructure is designed to accommodate a large drum of material indicated in phantom generally at 90. To hold the drum 90 securely requires that wedge blocks, or V-brackets, indicated at 92, be placed on either side of its center line, spaced apart a distance and raised a height such that the drum is prevented from rolling out from between the V-brackets 92. Pairs of brackets 92 may be mounted on flat plates 94 for ready connection to the basic pallet 10. It will be appreciated as well that plural sets of V-brackets 92 could be fixed to the plates 94 for carrying of more than one drum or other cylindrical object per pallet. Similarly it will be appreciated that a resilient or flexible belt could be provided to strap the drum onto the pallet 10 for an additional measure of security. As above, the plates 94 carrying the angle portions 92 may be affixed to the pallet 10 by the simple expedient of sheet metal screws indicated at 96. It will be appreciated that in this case, as in the other embodiments of the basic pallet 10 with additional superstructure, the basic pallet 10 may be provided with hooks 18 for engagement with operator selected ones of a series of vertically opening notches at the front of a modular stacking system and with a rear bar 20 for engagement with horizontally opening notches at the rear of the modular stacking system. Accordingly, the pallet with selected superstructure, is adapted for use with stack systems of the type in which pallets are stored at any selected position within the vertical array. That is, the spacing of the pallets is determined only by the goods stored thereon and not by prefixed location of immovable shelves within a shelving structure.

It will be appreciated by those skilled in the art that the combination of a highly space efficient modular shelving system not comprising fixed, immovable shelves but instead utilizing removable pallets which can be stored at substantially any desired vertical location within a given vertical shelving array, together with the adaptable superstructures attachable to the basic pallet according to the invention permits great flexibility and efficiency in the storage of goods. Specifically, only a limited number of basic pallets need to be kept on hand in order to store a wide variety of goods, since the pallets are made adaptable to the variety of goods by provision of the several superstructures described above; the fact that the basic pallets are designed to be used within an infinitely vertically adjustable positioning storage system allows their spacing to be optimized after the goods have been stored thereon, thus freeing the system from the constraints of fixed shelves and/or fixed classes of pallets.

It will be further appreciated by those skilled in the art that the description of the invention given above is exemplary and should not be construed as a limitation on its scope. On the contrary, it will be understood that in addition to the several superstructures described above in connection with the storage of particular classes of goods, other sorts of superstructures are likewise possible and could be readily envisioned and made affixable to the pallets according to the invention; likewise, of course, other sorts of basic pallet structures and methods of providing a vertical storage array dof pallets are possible in addition to the support rails and hook-notch arrangements shown.

Therefore, the scope of the invention should be construed as limited only by the scope of the following claims.

What is claimed is:

1. In combination:

a stationary support means, and a universal pallet for the storage of goods, said pallet comprising:

a generally planar upper surface, comprising means for affixation of selected superstructure means chosen for the convenient storage of classes of goods; and a base, said base comprising hook and bar means adapted to mate with said support means for storing said pallet, and means for mating with transport means;

said support means comprising front and rear upright support means, said front upright support means comprising a plurality of spaced vertically opening notches for mating with said hook means on said pallet, and said rear upright support means comprising a plurality of similarly spaced horizontally opening notches for engagement with said bar means.

2. The combination of claim 1 wherein said means for mating with transport means comprises a pair of spaced apertures in a wall of said base so sized as to mate with the tines of a fork lift transport.

3. The combination of claim 1 wherein said base comprises casters.

4. The combination of claim 1 wherein said means for affixation of selected superstructure, for the storage of goods comprises a series of points for connection of removable fasteners.

5. The combination of claim 1 in combination with superstructure selected so as to permit the ready storage of goods on said pallet.

6. The combination of claim 5 wherein said superstructure comprises a bin, the walls of said bin being comprised of a wire mesh.

7. The combination of claim 5 wherein said superstructure comprises a bin, the walls of said bin being constructed of substantially continuous metal sheeting.

8. The combination of claim 5 wherein said superstructure comprises a pair of spaced apart wire loops extending substantially vertically upward of said planar upper surface for storage of a reel of goods therebetween.

9. The combination of claim 5 wherein said superstructure comprises at least two pairs of wedges, the wedges of each pair being spaced apart from one another in a first direction and the pairs being spaced apart in a second direction perpendicular to said first direction whereby generally cylindrical objects may be stored between said opposing wedges of said pairs.

* * * * *